US008534488B1

(12) United States Patent
Naum et al.

(10) Patent No.: US 8,534,488 B1
(45) Date of Patent: Sep. 17, 2013

(54) TRASH CONTAINER LINER BAG

(76) Inventors: Thomas D. Naum, Brighton, NY (US); Joseph P. Gaudio, Kent, NY (US); James A. Bertsch, Pittsford, NY (US)

( * ) Notice: Subject to any disclaimer, the term of this patent is extended or adjusted under 35 U.S.C. 154(b) by 0 days.

(21) Appl. No.: 13/481,035

(22) Filed: May 25, 2012

Related U.S. Application Data

(60) Provisional application No. 61/519,700, filed on May 27, 2011.

(51) Int. Cl.
*B65D 25/16* (2006.01)

(52) U.S. Cl.
USPC ..... 220/495.11

(58) Field of Classification Search
USPC ..... 220/495.11, 495.08, 495.06, 908.1, 220/908, 264, 263, 262, 810, 845, 495.1, 220/9.4; D34/9, 8, 7; 383/77, 22, 26, 33
IPC ..... B65D 25/16, 25/14, 35/14
See application file for complete search history.

(56) References Cited

U.S. PATENT DOCUMENTS

| | | | | |
|---|---|---|---|---|
| 4,338,979 | A * | 7/1982 | Dow | 141/10 |
| 4,789,078 | A * | 12/1988 | Miller et al. | 220/832 |
| 4,890,736 | A * | 1/1990 | Johannes | 206/390 |
| 2005/0205579 | A1 * | 9/2005 | Buchalter et al. | 220/495.11 |
| 2008/0011910 | A1 * | 1/2008 | Ramsey | 248/100 |

FOREIGN PATENT DOCUMENTS

| | | | |
|---|---|---|---|
| FR | 2632274 | A1 * | 12/1989 |
| GB | 2203326 | A * | 10/1988 |

OTHER PUBLICATIONS

Translation of FR 2632274 (CAPY), Dec. 8, 1989, p. 3.*

* cited by examiner

*Primary Examiner* — Robert J Hicks
(74) *Attorney, Agent, or Firm* — Robert J. Bird

(57) ABSTRACT

A trash container includes a bottom receptacle with a hinged lid. The hinge connection makes hinge opening(s) along the hinge axis. A trash bag in the receptacle, which extends up and over the sides of the receptacle, includes upward-extending back tab(s) for placement through the hinge opening(s). A removable elastic band fits around the receptacle below the lid to secure the bag and tabs in place in the receptacle.

2 Claims, 3 Drawing Sheets

TRASH CONTAINER LINER BAG

CROSS-REFERENCE TO RELATED APPLICATION

Our related and copending Provisional Application No. 61/519,700 was filed on May 27, 2011. That filing date is claimed for this application.

BACKGROUND INFORMATION

This invention is a removable liner bag for a trash receptacle such as a wheeled rollout cart. Such rollout carts need to be cleaned or rinsed out from time to time, but their size makes it a cumbersome job, easily postponed by the homeowner.

The liner bag of this invention is easily set in place in a rollout cart, and it remains in place while the cart is lifted, emptied into a collection truck, and returned upright and empty to the roadside.

SUMMARY OF THE INVENTION

In summary, this invention is a trash container including a bottom receptacle with a hinged lid. The hinge connection makes hinge opening(s) along the hinge axis. A trash bag in the receptacle, which extends up and over the sides of the receptacle, includes upward-extending back tab(s) for placement through the hinge opening(s). A removable elastic band fits around the receptacle below the lid to secure the bag and tabs in place in the receptacle.

DRAWINGS

DESCRIPTION

Figure 1:
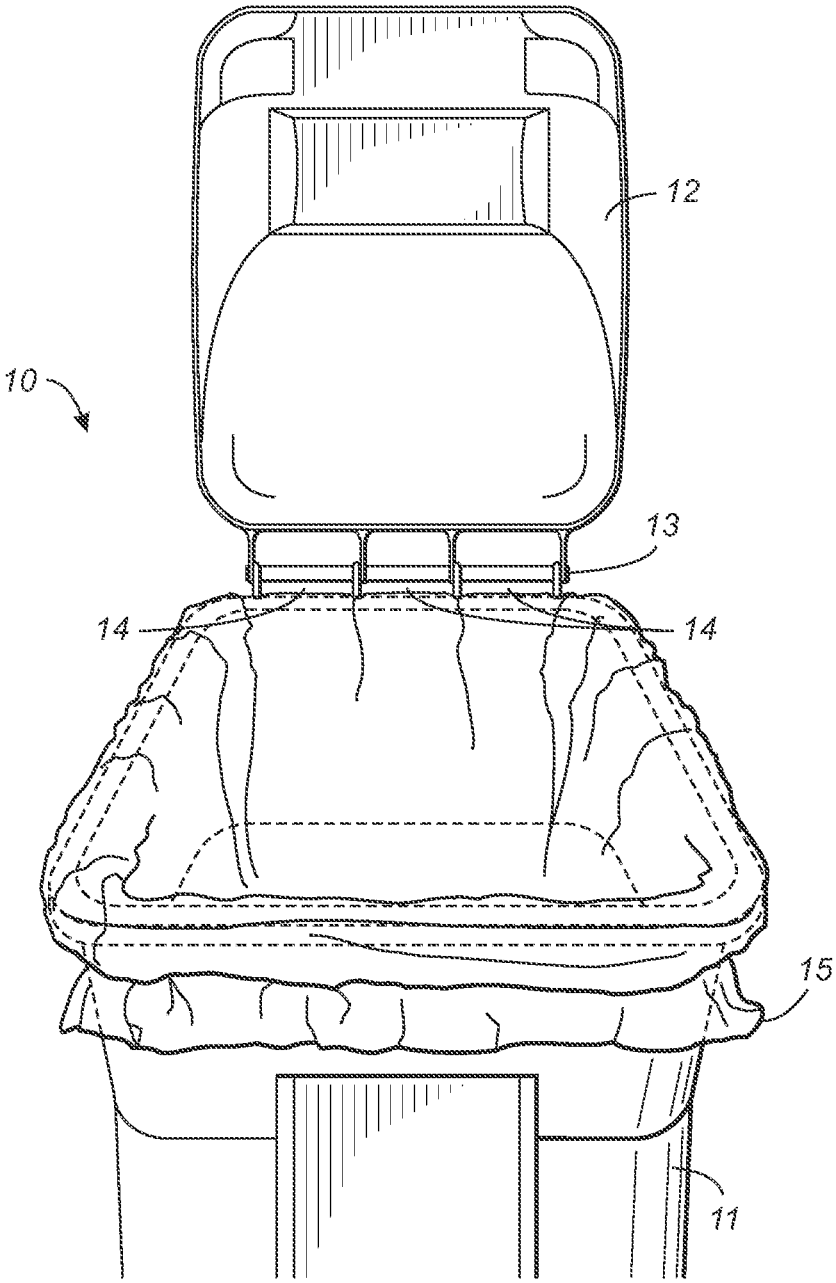
FIG. 1 is a front view of the top portion of a rollout cart with its lid raised up.

With reference now to the drawing, FIG. 1 shows a trash container or rollout cart 10 which includes a bottom receptacle 11 and a top lid 12 connected by a hinge 13 disposed along the top rear of the receptacle 11. Hinge openings 14 along the axis of the hinge 13 become open spaces or slots when the lid 12 is raised up as in FIG. 1.

Figure 2:
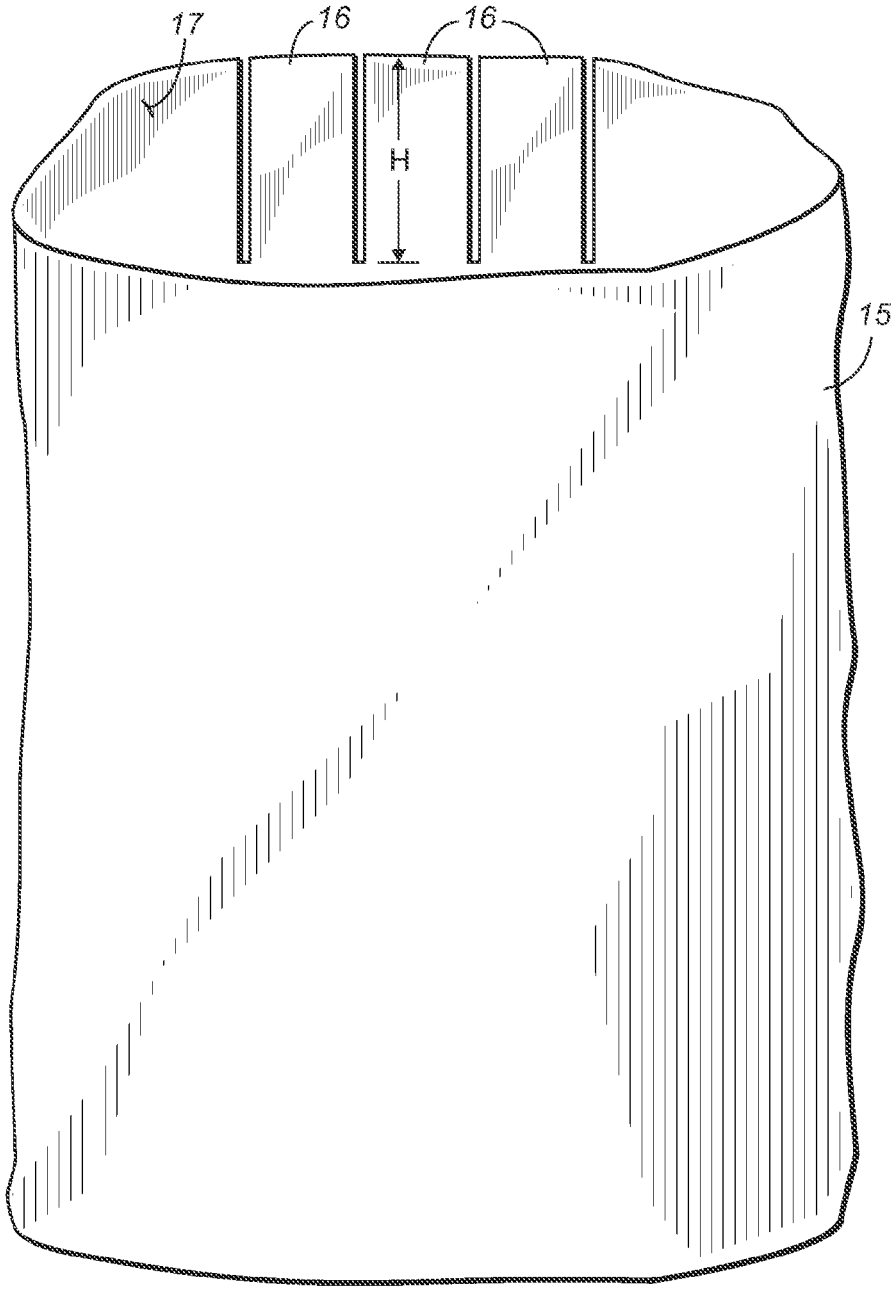
FIG. 2 is a front view of a plastic bag for placement in the cart of FIG. 1.

FIG. 2 shows a plastic bag 15 of size sufficient to fill and line the receptacle 11 and to extend up and over its top edges (FIG. 1). The back of the bag 15 includes a number (three in this example) of individual tabs 16 of height H (about 8" for example). The tabs 16 are part of the back side 17 of the bag 15.

For installation and use, the bag 15 is opened and inserted into the receptacle 11. The tabs 16 are separately tucked rearward through their respective hinge openings 14 and over the top of the receptacle back wall, as shown in FIG. 3.

Figure 3:
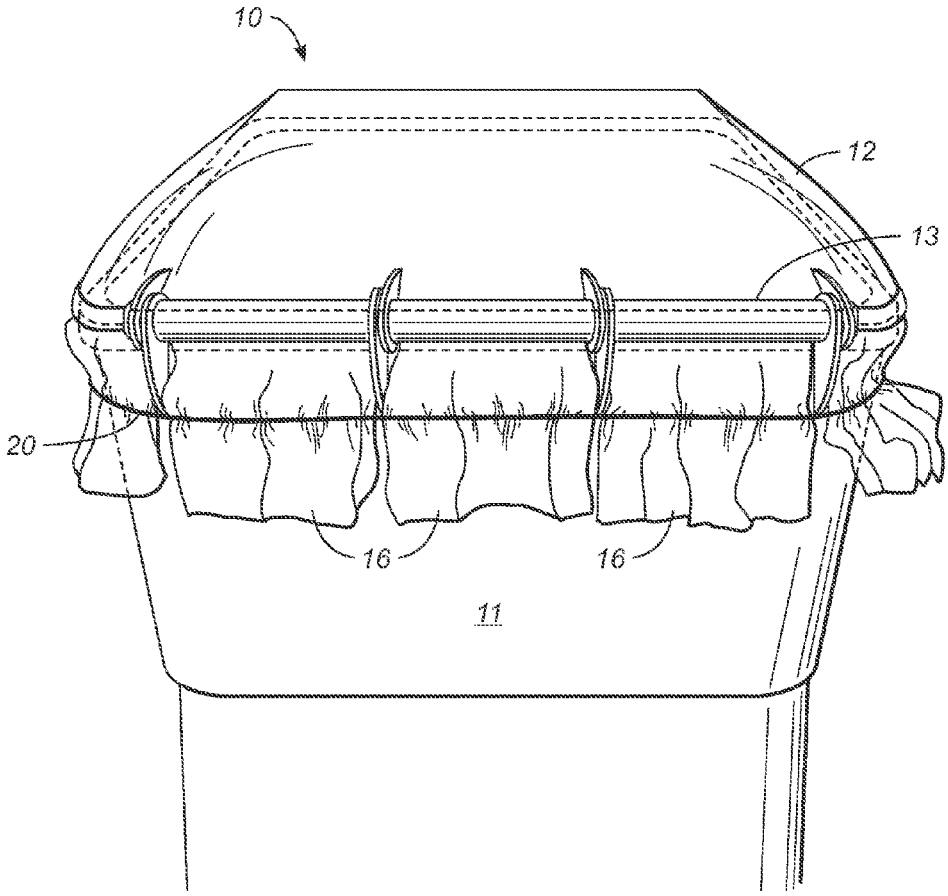
FIG. 3 is a rear view of the cart of FIG. 1, with the plastic bag placed within it.

The bag 15, thus placed into the receptacle 11, is secured in place by an elastic or rubber band 20 around the upper portion of the receptacle 11, just below the hinge 13 as shown in FIG. 3. The bag, secured by the elastic band 20, remains in place in the cart, even through the cart-emptying process. The user can choose to have the bag discharged with its contents by removing the band 20.

The bag 15 is shown with three tabs 16, to correspond with the three openings 14 in the hinge as shown. Other hinges with fewer hinge elements provide correspondingly fewer openings 14. Accordingly, bags for use with such other hinged lids would have two tabs, or one tab.

In the following claims, any terms indicative of orientation (e.g. front, back; left, right; upper, lower; top, bottom) are meant only to correspond with the illustrations and to facilitate an understanding of the claimed invention. Such terms are not intended as positive limitations.

The foregoing description, including any dimensions, of a preferred embodiment is illustrative. The concept and scope of the invention are not limited by such details but only by the following claims.

What is claimed is:

1. A trash container including:

a receptacle with a front wall, side walls, and a back wall;

a lid pivotally connected to said receptacle by a plurality of spaced hinge elements along the top of said back wall;

said receptacle and said lid forming between them a hinge opening between hinge elements when said lid is raised open;

a trash bag for placement in said receptacle, said bag including front, side, and back parts to drape over respective front, side, and back walls of said receptacle;

said back part of said bag including a tab portion placed through said hinge opening to drape over the top of said back wall; and an elastic band for removable placement around said receptacle below said lid to secure said bag to said receptacle.

2. A trash container including:

a receptacle with a front wall, side walls, and a back wall;

a lid mounted on said receptacle and connected with said receptacle by a plurality of spaced hinge elements atop said back wall;

said hinge elements forming between them a hinge opening when said lid is raised open;

a trash bag for placement in said receptacle, said bag including front, side, and back parts to drape over respective front, side, and back walls of said receptacle;

said back part of said bag including a tab portion placed through said hinge opening to drape over the top of said back wall; and an elastic band for removable placement around said receptacle below said lid to secure said bag to said receptacle.

* * * * *